United States Patent [19]

Occelli et al.

[11] Patent Number: 4,466,884

[45] Date of Patent: Aug. 21, 1984

[54] PROCESS FOR CRACKING HIGH METALS CONTENT FEEDSTOCKS USING A CRACKING CATALYST MIXTURE CONTAINING ANTIMONY AND/OR TIN

[75] Inventors: Mario L. Occelli, Allison Park; Harold E. Swift, Gibsonia, both of Pa.

[73] Assignee: Gulf Research & Development Company, Pittsburgh, Pa.

[21] Appl. No.: 453,290

[22] Filed: Dec. 27, 1982

[51] Int. Cl.[3] ..... C10G 29/04; C10G 11/05

[52] U.S. Cl. ..... 208/120; 208/52 CT; 208/113; 208/253

[58] Field of Search ..... 208/52 CT, 120, 251 R, 208/113, 253

[56] References Cited

U.S. PATENT DOCUMENTS

| | | | |
|---|---|---|---|
| 4,083,807 | 4/1978 | McKinney et al. | 208/120 X |
| 4,101,417 | 7/1978 | Mitchell et al. | 208/120 |
| 4,111,845 | 9/1978 | McKay | 208/120 X |
| 4,147,613 | 4/1979 | Gladrow | 208/120 |
| 4,148,714 | 4/1979 | Nielsen et al. | 208/114 |
| 4,153,536 | 5/1979 | McKay | 208/120 |
| 4,182,693 | 1/1980 | Gladrow | 208/120 X |
| 4,198,320 | 4/1980 | Chester et al. | 208/120 X |
| 4,289,605 | 9/1981 | Bartholic | 208/113 |
| 4,292,169 | 9/1981 | Gladrow | 208/120 |
| 4,321,129 | 3/1982 | Bertus et al. | 208/120 |

*Primary Examiner*—Delbert E. Gantz
*Assistant Examiner*—O. Chaudhuri
*Attorney, Agent, or Firm*—Deane E. Keith; Forrest D. Stine; Joseph J. Carducci

[57] ABSTRACT

A process for cracking high metals content feedstocks which comprises contacting said charge stock under catalytic cracking conditions with a novel catalyst composition comprising a solid cracking catalyst and a diluent containing antimony and/or tin.

22 Claims, 1 Drawing Figure

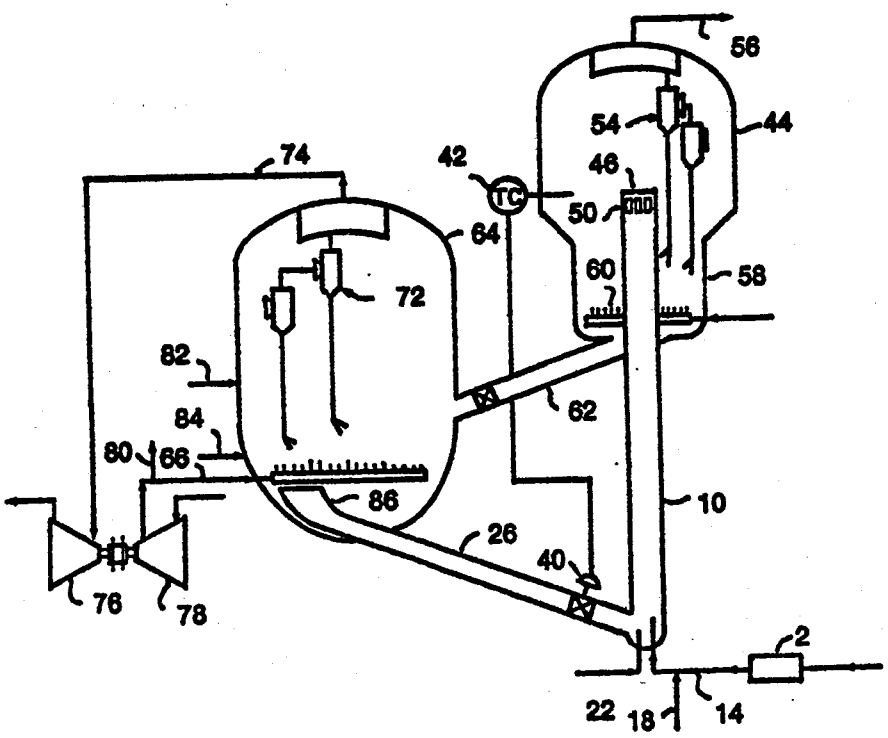
56
44
58
54
46
50
60
42
TC
64
72
74
82
84
86
80
66
76
78
62
26
40
10
2
14
18
22

PROCESS FOR CRACKING HIGH METALS CONTENT FEEDSTOCKS USING A CRACKING CATALYST MIXTURE CONTAINING ANTIMONY AND/OR TIN

BACKGROUND OF THE INVENTION

1. Field of the Invention

This invention relates to a process for cracking high metals content feedstocks which comprises contacting said charge stock under catalytic cracking conditions with a novel catalyst composition comprising (1) a solid cracking catalyst and (2) a diluent containing, or carrying, antimony and/or tin. By "antimony" and "tin", we mean to include not only the elements themselves but also compounds thereof.

2. Description of the Invention

U.S. Pat. No. 3,944,482 to Mitchell et al. discloses a process directed to the catalytic cracking of hydrocarbon feeds containing metals using a fluid catalyst having improved metals tolerant characteristics. Bartholic in U.S. Pat. No. 4,289,605 relates to a process for the catalytic cracking of hydrocarbon feeds containing metals using a catalyst composition containing a solid cracking catalyst and calcined microspheres (for example, calcined kaolin clay) having a surface area within the range of 10 to 15 $m^2$/gram.

SUMMARY OF THE INVENTION

We have found that catalytic cracking of high metals content feedstocks such as, for example, those containing iron, vanadium, nickel and copper, can be substantially improved by contacting said charge stocks under catalytic cracking conditions with a novel catalyst composition comprising a solid cracking catalyst and a diluent carrying antimony and/or tin. The improvement resides in the ability of the catalyst system to function well even when the catalyst carries a substantially high level of metal on its surface, for example, up to 5000 ppm of nickel or nickel equivalents, or even higher, or up to 20,000 ppm of vanadium. By "ppm of nickel equivalent" we mean ppm nickel+0.20 ppm vanadium. Thus feedstocks having very high metals content can be satisfactorily used herein. The novel composition is covered in our U.S. application Ser. No. 453,291, entitled "Catalytic Cracking Composition Containing Antimony and/or Tin", filed concurrently herewith.

The cracking catalyst component of the novel catalyst composition used in the novel process herein can be any cracking catalyst of any desired type having high activity. By "high activity" we mean catalyst of fresh MAT Activity above about 1.0, preferably up to about 4.0, or even higher, where $$\text{Activity} = \frac{\text{Wt \% Conversion}}{100 - \text{Wt \% Conversion}}$$

The "MAT Activity" was obtained by the use of a microactivity test (MAT) unit similar to the standard Davison MAT (see Ciapetta et al., Oil & Gas Journal, 65, 88 (1967). All catalyst samples were tested at 900° F. (482° C.) reaction temperature; 15 weight hourly space velocity; 80 seconds of catalyst contact time; and a catalyst to oil ratio of 2.9 with 2.5 grams of catalyst. The charge stock was a Kuwait gas oil having a boiling range of 500° F. to 800° F. (260° C. to 427° C.). Inspections of this Kuwait gas oil are shown in Table I below.

TABLE I

KUWAIT GAS OIL INSPECTIONS

| Stock Identification | MAT Feedstock |
|---|---|
| Inspections: | |
| Gravity, API, D-287 | 23.5 |
| Viscosity, SUS D2161, 130° F. | 94.7 |
| Viscosity, SUS D2161, 150° F. | 70.5 |
| Viscosity, SUS D2161, 210° F. | 50.8 |
| Pour Point, D97, °F. | +80 |
| Nitrogen, wt % | 0.074 |
| Sulfur, wt % | 2.76 |
| Carbon, Res., D524, wt % | 0.23 |
| Bromine No., D1159 | 5.71 |
| Aniline Point, °F. | 176.5 |
| Nickel, ppm | <0.1 |
| Vanadium, ppm | <0.1 |
| Distillation, D1160 at 760 mm | |
| End Point, °F. | 800 |
| 5 Pct. Cond. | 505 |
| Approx. Hydrocarbon Type Analysis: Vol. % | |
| Carbon as Aromatics | 23.1 |
| Carbon as Naphthenes | 10.5 |
| Carbon as Paraffins | 66.3 |

Thus, catalytic cracking catalysts suitable for use herein as host catalyst include amorphous silica-alumina catalysts; synthetic mica-montmorillonite catalysts as defined, for example in U.S. Pat. No. 3,252,889 to Capell et al.; and cross-linked clays (see, for example, Vaughn et al. in U.S. Pat. Nos. 4,176,090 and 4,248,739; Vaughn et al. (1980), "Preparation of Molecular Sieves Based on Pillared Interlayered Clays"; *Proceedings of the 5th International Conference on Zeolites,* Rees, L. V., Editor, Heyden, London, pages 94–101; and Lahav et al., (1978) "Crosslinked Smectites I Synthesis and Properties of Hydroxy Aluminum Montmorillonite", *Clay & Clay Minerals,* 26, pages 107–114; Shabtai, J. in U.S. Pat. No. 4,238,364; and Shabria et al. in U.S. Pat. No. 4,216,188).

Preferably, the host catalyst used herein is a catalyst containing a crystalline aluminosilicate, preferably exchanged with rare earth metal cations, sometimes referred to as "rare earth-exchanged crystalline aluminum silicate" or one of the stabilized hydrogen zeolites. Most preferably, the host catalyst is a high activity cracking catalyst.

Typical zeolites or molecular sieves having cracking activity which can be used herein as a catalytic cracking catalyst are well known in the art. Suitable zeolites are described, for example, in U.S. Pat. No. 3,660,274 to Blažek et al., or in U.S. Pat. No. 3,647,718 to Hayden et al. The descriptions of the crystalline aluminosilicates in the Blazek et al. and Hayden et al. patents are incorporated herein by reference. Synthetically prepared zeolites are initially in the form of alkali metal aluminosilicates. The alkali metal ions are exchanged with rare earth metal ions to impart cracking characteristics to the zeolites. The zeolites are, of course, crystalline, three-dimensional, stable structures containing a large number of uniform openings or cavities interconnected by smaller, relatively uniform holes or channels. The effective pore size of synthetic zeolites is suitably between six and 15 A in diameter. The overall formula for the preferred zeolites can be represented as follows:

$$xM_{2/n}O:Al_2O_3:1.5\text{–}6.5\ SiO_2:yH_2O$$

where M is a metal cation and n its valence and x varies from 0 to 1 and y is a function of the degree of dehydration and varies from 0 to 9. M is preferably a rare earth metal cation such as lanthanum, cerium, praseodymium, neodymium or mixtures of these.

Zeolites which can be employed herein include both natural and synthetic zeolites. These zeolites include gmelinite, chabazite, dachiardite, clinoptilolite, faujasite, heulandite, analcite, levynite, erionite, sodalite, cancrinite, nepheline, lazurite, scolecite, natrolite, offretite, mesolite, mordenite, brewsterite, ferrierite, and the like. The faujasites are preferred. Suitable synthetic zeolites which can be treated in accordance with this invention include zeolites X, Y, A, L, ZK-4, B, EF, R, HJ, M, Q, T, W, Z, alpha and beta, ZSM-types and omega. The term "zeolites" as used herein contemplates not only aluminosilicates but substances in which the aluminum is replaced by gallium or boron and substances in which the silicon is replaced by germanium.

The preferred zeolites for this invention are the synthetic faujasites of the types Y and X or mixtures thereof.

To obtain good cracking activity the zeolites have to be in a proper form. In most cases this involves reducing the alkali metal content of the zeolite to as low a level as possible. Further, a high alkali metal content reduces the thermal structural stability, and the effective lifetime of the catalyst will be impaired as a consequence thereof. Procedures for removing alkali metals and putting the zeolite in the proper form are well known in the art as described in U.S. Pat. No. 3,537,816.

The crystalline aluminosilicate zeolites, such as synthetic faujasite, will under normal conditions crystallize as regularly shaped, discrete particles of approximately one to ten microns in size, and, accordingly, this is the size range normally used in commercial catalysts. The particle size of the zeolites can be, for example, from about 0.5 to about 10 microns but generally from about 1 to about 2 microns or less. Crystalline zeolites exhibit both an interior and an exterior surface area, with the largest portion of the total surface area being internal. Blockage of the internal channels by, for example, coke formation and contamination by metals poisoning will greatly reduce the total surface area.

Especially preferred as the catalytically active component of the catalyst system used herein is a crystalline aluminosilicate, such as defined above, dispersed in a refractory metal oxide matrix, for example, as set forth in U.S. Pat. No. 3,944,482 to Mitchell et al., referred to hereinabove.

The matrix material in the host catalyst can be any well-known heat-stable or refractory metal compounds, for example, metal oxides, such as silica, magnesia, boron, zirconia, or mixtures of these materials or suitable large pore clays, cross-linked clays or mixed oxide combinations.

The particular method of forming the catalyst matrix does not form a part of this invention. Any method which produces the desired cracking activity characteristics can suitably be employed. Large pored refractory metal oxide materials suitable for use as a matrix can be obtained as articles of commerce from catalyst manufacturers or they can be prepared in ways well known in the art such as described, for example, in U.S. Pat. No. 2,890,162, the specification of which is incorporated herein by reference.

The amount of the zeolitic material dispersed in the matrix can suitably be from about 10 to about 60 weight percent, preferably from about 10 to about 40 weight percent, but most preferably from about 20 to about 40 weight percent of the final catalyst. The method of forming the final composited catalyst also forms no part of this invention, and any method well known to those skilled in this art is acceptable. For example, finely divided zeolite can be admixed with the finely divided matrix material, and the mixture spray dried to form the final catalyst. Other suitable methods are described in U.S. Pat. Nos. 3,271,418; 3,717,587; 3,657,154; and 3,676,330; whose descriptions are incorporated herein by reference. The zeolite can also be grown on the matrix material if desired, as defined, for example in U.S. Pat. No. 3,647,718 to Hayden et al., referred to above.

The second component of the novel catalyst cracking composition used herein, as a separate and distinct entity, is a diluent, that is, a compound, or a number of compounds, having little activity or, in other words, having a MAT Activity below about 1.0. Examples of inert diluents that can be used include alumina, magnesium compounds, titanium compounds, etc. By "magnesium compound" we mean to include magnesium oxide, attapulgite, sepiolite, hectorite, chrysotile and other magnesium-containing clay minerals, as defined, for example, by R. E. Grim in "Clay Mineralogy", McGraw, Hill (1968). By "titanium compounds" we mean to include titanium dioxide in any of its three crystalline modifications (anatase, brookite and rutile) and the mineral perovskite ($CaTiO_3$) as defined by Cotton and Wilkinson in "Advanced Inorganic Chemistry", Interscience Publishers, 3rd Edition (1972). The inert diluent(s) need not be used alone but can be used in combination with any suitable heat-stable metal compounds. By "combination" we mean that the inert diluent(s) and heat-stable metal compound(s) can be physically discrete components. By "heat-stable" metal compound we mean to include metal compounds that will, under the temperatures and conditions existing in a catalytic cracking unit, not decompose, or if they do compose, will remain stable in such environment. Specific examples of suitable heat-stable metal compounds include the metal oxides of aluminum, magnesium, boron, zirconium, calcium, phosphorus, titanium, etc. The amount of heat-stable metal compound present can be up to about 90 weight percent relative to the inert diluent, although in general the amount will be from about 10 to about 50 weight percent, or even higher.

The second component must be carefully selected. In order to obtain the desired results herein, it is most desirable that its fresh surface area be in the range of about 30 to about 1000 $m^2$/gram, preferably about 50 to about 600 $m^2$/gram. Equally critical is the total pore volume, which must be in the range of about 0.05 to about 3.0 cc/gram, preferably about 0.1 to about 2.5 cc/gram. It is desirable that the average pore radius be in the range of about 5 to about 200 A, preferably about 10 to 110 A. The particle size can vary over a wide range, but generally will be in the range of about 20 to about 150 microns, preferably about 20 to about 90 microns.

Elemental antimony or elemental tin or any antimony or tin compound capable of reacting with elemental nickel or elemental vanadium or with compounds of nickel or vanadium in a catalytic cracking environment to form inert compounds therewith possessing reduced deactivating effects on catalytic cracking catalysts can be used herein. Specific examples of antimony and tin compounds, both organic and inorganic, that can be used herein are defined, for example, in U.S. Pat. No. 4,321,129 to Bertus et al. Specific examples of compounds that can be particularly used include triphenylstilbine and tetraphenyltin. The weight ratio of the antimony compound to the tin compound can vary over a wide range, for example, from about 1:0 to about 0:1, or from about 0.1:0.9 to about 0.9:0.1, or even about 0.5:0.5. These compounds can be deposited on the diluent surface in any conventional manner, again, as for example in said U.S. patent to Bertus et al. wherein the compounds are deposited on a catalytic surface. In some preferred examples, the antimony and/or tin compound can be physically mixed with the diluent, or can be dissolved in a suitable solvent, aqueous or hydrocarbon, and the diluent impregnated therewith, followed by removal of the solvent, etc. Prior to using the diluent, or during the cracking operation, the diluent with the antimony and/or tin compound thereon is heated in a reducing or oxidizing atmosphere at ambient pressure or any elevated pressure in a range of, for example, about 400° to about 850° C.

The total amount of antimony compound, tin compound or combinations thereof initially mounted on the diluent will be in the range of about 0.05 to about 20 weight percent, preferably about 0.1 to about 2.0 weight percent, based on the defined diluent used.

The weight ratio of the catalytically active component to the diluent (the second component) can be in the range of about 10:90 to about 90:10, preferably in the range of about 50:50 to about 70:30.

The novel catalyst composition used herein in the defined novel process possesses an unusually high tolerance to metals, particularly to nickel and vanadium. This can be seen from the following wherein the novel catalyst defined above finds itself in an environment containing nickel or vanadium. Nickel and vanadium will have a tendency to deposit on both the catalytic component and on the diluent. The nickel on the diluent will react with the antimony compound thereon and will form inert nickel compounds. Unfortunately, nickel on the catalytic component will tend to remain thereon and will tend to decrease gasoline yield and generate coke and hydrogen. We have found, however, that some of the antimony compound will tend to vaporize and will react with the nickel in the oil to form additional inert nickel compounds. We have also found that with vanadium in the system, the presence of tin on the inert diluent will operate therewith to negate the tendency of the vanadium to deactivate the catalyst. In this case, vanadium on the diluent will react with the tin compound thereon to form inert vanadium compounds. While the tin compound on the diluent, unlike the antimony compound thereon, will not tend to vaporize, the vanadium compound on the catalyst surface will tend to migrate to the diluent surface and thereby react with the tin compound thereon to form the inert vanadium compounds. At the same time, some additional reactions can occur between the antimony and the vanadium to form inert vanadium compounds and between the tin and the nickel compounds to form inert nickel compounds. In this way the deactivating effects of nickel and/or vanadium on a catalytic surface can be greatly reduced by using antimony and/or tin compounds on an inert diluent associated with such catalytic component. Thus, the beneficial effects on the antimony compounds and/or tin compounds are obtained, though none of these compounds is mounted on the catalytic surface to interfere with the surface properties thereof.

The catalyst composition defined above thus possesses a high tolerance to metals and is therefore particularly useful in the cracking of high metals content charge stocks. Suitable charge stocks include crude oil, residuums or other petroleum fractions which are suitable catalytic cracking charge stocks except for the high metals contents. A high metals content charge stock for purposes of the process of this invention is defined as one having a total metals concentration equivalent to or greater than a value of ten as calculated in accordance with the following relationship:

$$10[Ni]+[V]+[Fe]\geqq 10$$

where [Ni], [V] and [Fe] are the concentrations of nickel, vanadium and iron, respectively, in parts per million by weight. The process is particularly advantageous when the charge stock metals concentration is equal to or greater than 100 in the above equation. It is to be understood therefore that the catalyst compositions described above can be used in the catalytic cracking of any hydrocarbon charge stock containing metals, but is particularly useful for the treatment of high metals content charge stocks since the useful life of the catalyst is increased. The charge stocks can also be derived from coal, shale or tar sands. Thus charge stocks which have a metals content value of at least about 10 in accordance with the above equation cannot be treated as well as desired economically in commercial processes today due to high catalyst make-up rates, but can now be treated utilizing the catalyst compositions described and claimed herein. Typical feedstocks are heavy gas oils or the heavier fractions of crude oil in which the metal contaminants are concentrated. Particularly preferred charge stocks for treatment by the process of this invention include deasphalted oils boiling above about 900° F. (482° C.) at atmospheric pressure; heavy gas oils boiling from about 650° F. to about 1100° F. (343° C. to 593° C.) at atmospheric pressure; atmospheric or vacuum tower bottoms boiling above about 650° F.

The preferred method of operating the process of this invention is by fluid catalytic cracking. Hydrogen is generally not added to the reaction.

A suitable reactor-regenerator for carrying out the process claimed herein is shown in the attached FIG. I. The cracking occurs in the presence of the fluidized novel catalyst composition defined herein in an elongated reactor tube 10 which is referred to as a riser. The riser has a length to diameter ratio of above 20 or above 25. The charge stock to be cracked is passed through preheater 2 to heat it to about 600° F. (315.6° C.) and is then charged into the bottom of riser 10 to the end of line 14. Steam is introduced into oil inlet line 14 through line 18. Steam is also introduced independently to the bottom of riser 10 through line 22 to help carry upwardly into the riser regenerated catalyst which flows to the bottom of the riser through transfer line 26.

The oil charge to be cracked in the riser is, for example, a heavy gas oil having a boiling range of about 650° F. to about 1100° F. (343° to 593° C.). The steam added to the riser can amount to about 10 weight percent based on the oil charge, but the amount of steam can vary widely. The catalyst employed is the novel catalyst composition defined above in a fluid form and is added to the bottom of the riser. The riser temperature range is suitably about 900° F. to about 1100° F. (482° C. to 593° C.) and is controlled by measuring the temperature of the product from the riser and then adjusting the opening of valve 40 by means of temperature controller 42 which regulates the inflow of hot regenerated catalyst to the bottom of riser 10. The temperature of the regenerated catalyst is above the control temperature in the riser so that the incoming catalyst contributes heat to the cracking reaction. The riser pressure is between about 10 and about 35 psig. Between about 0 and about 5 percent of the oil charge to the riser can be recycled. The residence time of both hydrocarbon and catalyst in the riser is very small and ranges from about 0.5 to about 5 seconds. The velocity through the riser is about 35 to about 55 feet per second and is sufficiently high so that there is little or no slippage between the hydrocarbon and the catalyst flowing through the riser. Therefore no bed of catalyst is permitted to build up within the riser whereby the density within the riser is very low. The density within the riser is a maximum of about 4 pounds per cubic foot at the bottom of the riser and decreases to about 2 pounds per cubic foot at the top of the riser. Since no dense bed of catalyst is permitted to build up within the riser, the space velocity through the riser is unusually high and will have a range between about 100 or about 120 and about 600 weight hydrocarbon per hour per instantaneous weight of catalyst in the reactor. No significant catalyst buildup within the reactor is permitted to occur, and the instantaneous catalyst inventory within the riser is due to a flowing catalyst to oil weight ratio between about 4:1 and about 15:1, the weight ratio corresponding to the feed ratio.

The hydrocarbon and catalyst exiting from the top of each riser is passed into a disengaging vessel 44. The top of the riser is capped at 46 so that discharge occurs through lateral slots 50 for proper dispersion. An instantaneous separation between hydrocarbon and catalyst occurs in the disengaging vessel. The hydrocarbon which separates from the catalyst is primarily gasoline together with some heavier components and some lighter gaseous components. The hydrocarbon effluent passes through cyclone system 54 to separate catalyst fines contained therein and is discharged to a fractionator through line 56. The catalyst separated from hydrocarbon is disengager 44 immediately drops below the outlets of the riser so that there is no catalyst level in the disengager but only in a lower stripper section 58. Steam is introduced into catalyst stripper section 58 through sparger 60 to remove any entrained hydrocarbon in the catalyst.

Catalyst leaving stripper 58 passes through transfer line 62 to a regenerator 64. This catalyst contains carbon deposits which tend to lower its cracking activity and as much carbon as possible must be burned from the surface of the catalyst. This burning is accomplished by introduction to the regenerator through line 66 of approximately the stoichiometrically required amount of air for combustion of the carbon deposits. The catalyst from the stripper enters the bottom section of the regenerator in a radial and downward direction through transfer line 62. Flue gas leaving the dense catalyst bed in regenerator 64 flows through cyclones 72 wherein catalyst fines are separated from flue gas permitting the flue gas to leave the regenerator through line 74 and pass through a turbine 76 before leaving for a waste heat boiler wherein any carbon monoxide contained in the flue gas is burned to carbon dioxide to accomplish heat recovery. Turbine 76 compresses atmospheric air in air compressor 78 and this air is charged to the bottom of the regenerator through line 66.

The temperature throughout the dense catalyst bed in the regenerator is about 1250° F. (676.7° C.). The temperature of the flue gas leaving the top of the catalyst bed in the regenerator can rise due to afterburning of carbon monoxide to carbon dioxide. Approximately a stoichiometric amount of oxygen is charged to the regenerator, and the reason for this is to minimize afterburning of carbon monoxide to carbon dioxide above the catalyst bed to avoid injury to the equipment, since at the temperature of the regenerator flue gas some afterburning does occur. In order to prevent excessively high temperatures in the regenerator flue gas due to afterburning, the temperature of the regenerator flue gas is controlled by measuring the temperature of the flue gas entering the cyclones and then venting some of the pressurized air otherwise destined to be charged to the bottom of the regenerator through vent line 80 in response to this measurement. The regenerator reduces the carbon content of the catalyst from about $1\pm0.5$ weight percent to about 0.2 weight percent or less. If required, steam is available through line 82 for cooling the regenerator. Makeup catalyst is added to the bottom of the regenerator through line 84. Hopper 86 is disposed at the bottom of the regenerator for receiving regenerated catalyst to be passed to the bottom of the reactor riser through transfer line 26.

While in FIG. I it has been shown that the novel catalyst composition herein can be introduced into the system as makeup by way of line 84, it is apparent that the catalyst composition, as makeup, or as fresh catalyst, in whole or in part, can be added to the system at any desirable or suitable point, for example, in line 26 or in line 14. Similarly, the components of the novel catalyst system need not be added together but can be added separately at any of the respective points defined above. The amount added will vary, of course, depending upon the charge stock used, the catalytic cracking conditions in force, the conditions of regeneration, the amount of metals present in the catalyst under equilibrium conditions, etc.

The reaction temperature in accordance with the above described process is at least about 900° F. (482° C.). The upper limit can be about 1100° F. (593.3° C.) or more. The preferred temperature range is about 950° F. to about 1050° F. (510° C. to 565.6° C.). The reaction total pressure can vary widely and can be, for example, about 5 to about 50 psig (0.34 to 3.4 atmospheres), or preferably, about 20 to about 30 psig (1.36 to 2.04 atmospheres). The maximum residence time is about 5 seconds, and for most charge stocks the residence time will be about 1.5 to about 2.5 seconds or, less commonly, about 3 to about 4 seconds. For high molecular weight charge stocks, which are rich in aromatics, residence times of about 0.5 to about 1.5 seconds are suitable in order to crack mono- and diaromatics and naphthenes which are the aromatics which crack most easily and which produce the highest gasoline yield, but to terminate the operation before appreciable cracking of polyaromatics occurs because these materials produce high yields of coke and $C_2$ and lighter gases. The length to diameter ratio of the reactor can vary widely, but the reactor should be elongated to provide a high linear velocity, such as about 25 to about 75 feet per second; and to this end a length to diameter ratio above about 20 to about 25 is suitable. The reactor can have a uniform diameter or can be provided with a continuous taper or a stepwise increase in diameter along the reaction path to maintain a nearly constant velocity along the flow path. The amount of diluent can vary depending upon the ratio of hydrocarbon to diluent desired for control purposes. If steam is the diluent employed, a typical amount to be charged can be about 10 percent by volume, which is about 1 percent by weight, based on hydrocarbon charge. A suitable but nonlimiting proportion of diluent gas, such as steam or nitrogen, to fresh hydrocarbon feed can be about 0.5 to about 10 percent by weight.

The catalyst particle size (of each of the two components, that is, of the catalytically-active component and of the diluent) must render it capable of fluidization as a disperse phase in the reactor. Typical and non-limiting fluid catalyst particle size characteristics are as follows:

| Size (Microns) | 0–20 | 20–45 | 45–75 | >75 |
|---|---|---|---|---|
| Weight percent | 0–5 | 20–30 | 35–55 | 20–40 |

These particle sizes are usual and are not peculiar to this invention. A suitable weight ratio of catalyst to total oil charge is about 4:1 to about 25:1, preferably about 6:1 to about 10:1. The fresh hydrocarbon feed is generally preheated to a temperature of about 600° F. to about 700° F. (316° C. to 371° C.) but is generally not vaporized during preheat and the additional heat required to achieve the desired reactor temperature is imparted by hot, regenerated catalyst.

The weight ratio of catalyst to hydrocarbon in the feed is varied to affect variations in reactor temperature. Furthermore, the higher the temperature of the regenerated catalyst the less catalyst is required to achieve a given reaction temperature. Therefore, a high regenerated catalyst temperature will permit the very low reactor density level set forth below and thereby help to avoid back mixing in the reactor. Generally catalyst regeneration can occur at an elevated temperature of about 1250° F. (676.6° C.) or more to reduce the level of carbon on the regenerated catalyst from about 0.6 to about 1.5, generally about 0.05 to 0.3 percent by weight. At usual catalyst to oil ratios in the feed, the quantity of catalyst is more than ample to achieve the desired catalytic effect and therefore if the temperature of the catalyst is high, the ratio can be safely decreased without impairing conversion. Since zeolitic catalysts, for example, are particularly sensitive to the carbon level on the catalyst, regeneration advantageously occurs at elevated temperatures in order to lower the carbon level on the catalyst to the stated range or lower. Moreover, since a prime function of the catalyst is to contribute heat to the reactor, for any given desired reactor temperature the higher the temperature of the catalyst charge, the less catalyst is required. The lower the catalyst charge rate, the lower the density of the material in the reactor. As stated, low reactor densities help to avoid backmixing.

The reactor linear velocity while not being so high that it induces turbulence and excessive backmixing, must be sufficiently high that substantially no catalyst accumulation or buildup occurs in the reactor because such accumulation itself leads to backmixing. (Therefore, the catalyst to oil weight ratio at any position throughout the reactor is about the same as the catalyst to oil weight ratio in the charge.) Stated another way, catalyst and hydrocarbon at any linear position along the reaction path both flow concurrently at about the same linear velocity, thereby avoiding significant slippage of catalyst relative to hydrocarbon. A buildup of catalyst in the reactor leads to a dense bed and backmixing, which in turn increases the residence time in the reactor, for at least a portion of the charge hydrocarbon induces aftercracking. Avoiding a catalyst buildup in the reactor results in a very low catalyst inventory in the reactor, which in turn results in a high space velocity. Therefore, a space velocity of over 100 to 120 weight of hydrocarbon per hour per weight of catalyst inventory is highly desirable. The space velocity should not be below about 35 and can be as high as about 500. Due to the low catalyst inventory and low charge ratio of catalyst to hydrocarbon, the density of the material at the inlet of the reactor in the zone where the feed is charged can be only about 1 to less than 5 pounds per cubic foot, although these ranges are non-limiting. An inlet density in the zone where the low molecular weight feed and catalyst is charged below about 4 pounds per cubic foot is desirable since this density range is too low to encompass dense bed systems which induce backmixing. Although conversion falls off with a decrease in inlet density to very low levels, it has been found the extent of aftercracking to be a more limiting feature than total conversion of fresh feed, even at an inlet density of less than about 4 pounds per cubic foot. At the outlet of the reactor the density will be about half of the density at the inlet because the cracking operation produces about a four-fold increase in mols of hydrocarbon. The decrease in density through the reactor can be a measure of conversion.

The above conditions and description of operation are for the preferred fluid bed riser cracking operation. For cracking in the older conventional fluid bed operation or in a fixed-bed operation, the particular reaction conditions are well known in the art.

DESCRIPTION OF PREFERRED EMBODIMENTS

A number of catalysts were evaluated for metals tolerance in accordance with the process claimed herein. Each diluent used in the following runs was heat shocked at 1000° F. (538° C.) overnight and then metal impregnated with triphenylstilbine or tetraphenyltin, followed by calcination at 1000° F. (538° C.). The diluent was then added, as a separate and distinct entity to the cracking catalyst (GRZ-1). Each catalyst mixture was heat shocked at 1100° F. (593° C.) for one hour, contaminated with nickel and vanadium by impregnation with nickel and vanadium naphthenates, followed by calcination at 1000° F. (538° C.) for 10 hours and a steam treatment at 1350° F. (732.3° C.) with about 100 percent steam for 10 hours. The average pore radii were determined after calcination, but before the steam treatment. Each of the catalysts carried on its surface 5000 ppm of nickel equivalents (3,800 parts per million of nickel and 6,000 parts per million of vanadium).

The "MAT Activity" was obtained by the use of the microactivity test previously described. The gas oil employed was described in Table I.

The catalysts used in the tests included GRZ-1 alone and physical mixtures of GRZ-1 and one of the following diluents:

1. Meta-kaolin
2. Alumina in combination with (a) Antimony oxide ($Sb_2O_3$ and $Sb_2O_5$) or (b) Tin Oxide ($SnO_2$ and SnO)

wherein the weight ratios of GRZ-1 to diluent was 60:40. GRZ-1, meta-kaolin, and alumina are defined further below:

| | |
|---|---|
| GRZ-1 | A commercial cracking catalyst containing a high zeolite content composited with a refractory metal oxide matrix. |
| Meta kaolin | A clay predominating in silica and alumina in a 2:1 molar ratio, such as used in U.S. Pat. No. 4,289,605. |
| Alumina | A commercial alumina ($Al_2O_3$) purchased from Harshaw. |

The surface properties of GRZ-1 and each of the diluents are set forth below in Table II:

TABLE II

| Catalyst | Surface Area, $m^2/g$ | Pore Volume, cc/g | Average Pore Radius, A |
|---|---|---|---|
| GRZ-1 | 222 | 0.17 | 16 |
| Meta-Kaolin | 10 | 0.04 | 80 |
| Alumina with 1% Tin | 167 | 0.34 | 41 |
| Alumina with 1% Antimony | 205 | 0.35 | 34 |
| Alumina | 344 | 0.21 | 12 |

The data obtained are tabulated below in Table III:

TABLE III

| Run No. | Catalyst | Conversion, Vol. % of Fresh Feed | $C_5$+ (Gasoline) Vol. % of Fresh Feed | Carbon, Wt % of Catalyst | Hydrogen, Wt % of Fresh Feed |
|---|---|---|---|---|---|
| 1 | GRZ-1 | 60 | 37.6 | 5.2 | 0.58 |
| 2 | Meta-Kaolin* | 49.4 | 33.8 | 3.1 | 0.34 |
| 3 | Alumina with 1% Antimony Oxide* | 65.7 | 40.0 | 5.7 | 0.66 |
| 4 | Alumina with 2% Antimony Oxide* | 64.5 | 40.5 | 6.0 | 0.60 |
| 5 | Alumina with 1% Tin Oxide* | 65.6 | 40.5 | 6.1 | 0.67 |

*GRZ-1 diluted with indicated additive. Resultant catalyst contained GRZ-1 and diluent in a weight ratio of 60:40. All catalysts contaminated with 5000 parts per million of nickel equivalents.

The unusual results obtained by operation in accordance with the process defined herein are seen from the data in Table III. Thus, in Run No. 1, wherein the process was operated with a commercially available high activity catalyst, which has excellent metals tolerant characteristics when used in catalytic cracking of hydrocarbonaceous feeds, excellent results were obtained, even with the catalyst carrying 5000 ppm nickel equivalents. When in Run No. 2, the zeolite catalyst of Run No. 1 was diluted with metakaolin in a weight ratio of 60:40, following the teachings of U.S. Pat. No. 4,289,605 of Bartholic, inferior results were obtained compared with those obtained in Run No. 1, in that conversion was reduced to 49.4 percent, with a drop in gasoline production. However, when the zeolitic catayst was combined with a heat-stable refractory aluminum oxide in combination with antimony oxide or tin oxide in Runs Nos. 3 to 5, conversions and amounts of gasoline were even better than the results obtained in Run No. 1. This is surprising, in that the diluents used in Runs Nos. 3 to 5 do not contain zeolite, and yet when a portion of the catalytically active component was replaced with such diluent, excellent results were still obtained.

An additional series of runs was carried out similarly to Runs Nos. 1 to 5 above wherein catalyst composition mixtures were employed containing GRZ-1 alone or 60 weight percent of GRZ-1 and 40 weight percent of alumina alone or alumina in combination with antimony oxide or tin oxide. In each case the catalyst carried one weight percent vanadium on its surface. Vanadium was deposited on the catalyst composition surfaces using vanadium naphthenate following the procedure of Runs Nos. 1 to 5. The data obtained are tabulated below in Table IV.

TABLE IV

| Run No. | Catalyst | Conversion, Vol. % of Fresh Feed | $C_5$+ (Gasoline) Vol. % of Fresh Feed | Carbon, Wt % of Catalyst | Hydrogen, Wt % of Fresh Feed |
|---|---|---|---|---|---|
| 6 | GRZ-1 | 58.0 | 40.7 | 2.4 | 0.20 |
| 7 | GRZ-1 with Alumina | 60.5 | 34.4 | 6.9 | 0.80 |
| 8 | GRZ-1 with Alumina and 1% Antimony Oxide | 61.6 | 38.1 | 5.4 | 0.62 |
| 9 | GRZ-1 with Alumina and 2% Antimony Oxide | 62.9 | 39.6 | 5.6 | 0.60 |
| 10 | GRZ-1 with Alumina and 1% Tin Oxide | 61.7 | 37.1 | 5.8 | 0.69 |

The advantages of operating a catalytic cracking process using the novel catalyst herein are further apparent from the data in Table IV. It can be seen from Table IV that even when the catalyst composition claimed herein carried one weight percent vanadium (10,000 ppm vanadium), the level of conversion was higher than when GRZ-1 alone or GRZ-1 in combination with alumina alone were used in Runs Nos. 6 and 7.

Obviously many modifications and variations of the invention, as herein above set forth, can be made without departing from the spirit and scope thereof and, therefore, only such limitations should be imposed as are indicated in the appended claims.

We claim:

1. A process for the catalytic cracking of a high metals content charge stock which comprises contacting said charge stock under catalytic cracking conditions with a catalyst composition comprising a cracking catalyst having high activity and, as a separate and distinct entity, a diluent of little cracking activity having a MAT Activity below about 1.0 selected from the group consisting of magnesium-containing clay minerals and containing at least one metal selected from the group consisting of antimony and tin.

2. The process of claim 1 wherein said diluent has a surface area of about 30 to about 1000 $m^2$/gram, a pore volume of about 0.05 to about 3.0 cc/gram, and an average pore radius of about 5 to about 200 A.

3. The process of claim 1 wherein said diluent has a surface area of about 50 to about 600 $m^2$/gram and a pore volume of about 0.1 to about 2.5 cc/gram and an average pore radius of about 10 to about 110 A.

4. The process of claim 1 wherein said diluent also contains at least one metal oxide of silicon, aluminum, magnesium, calcium, phosphorus, boron, zirconium, or titanium.

5. The process of claim 1 wherein said metal component is an antimony compound.

6. The process of claim 1 wherein said metal component is a tin compound.

7. The process of claim 1 wherein said metal component is triphenylstilbine.

8. The process of claim 1 wherein said metal component is tetraphenyltin.

9. The process of claim 1 wherein antimony and tin are present and the weight ratio of the antimony to tin is in the range of about 0.1:1 to about 0.9:1.

10. The process of claim 1 wherein antimony and tin are present and the weight ratio of the antimony to tin is in the range of about 0.5:0.5.

11. The process of claim 1 wherein the amount of said metal component relative to said diluent is in the range of about 0.05 to about 20 weight percent.

12. The process of claim 1 wherein the amount of said metal component relative to said diluent is in the range of about 0.1 to about 2.0 weight percent.

13. The process of claim 1 wherein the weight ratio of said cracking catalyst to said diluent is in the range of about 10:90 to about 90:10.

14. The process of claim 1 wherein the weight ratio of said cracking catalyst to said diluent is in the range of about 50:50 to about 70:30.

15. The process of claim 1 wherein said cracking catalyst has a MAT activity above about 1.0.

16. The process of claim 1 wherein said cracking catalyst has a MAT activity of about 1.0 to about 4.0.

17. The process of claim 1 wherein said cracking catalyst is an amorphous silica-alumina catalyst.

18. The process of claim 1 wherein said cracking catalyst is a cross-linked clay.

19. The process of claim 1 wherein said cracking catalyst is a synthetic mica-montmorillonite.

20. The process of claim 1 wherein said cracking catalyst contains a crystalline aluminosilicate.

21. The process of claim 1 wherein said cracking catalyst contains a stabilized hydrogen crystalline aluminum silicate.

22. The process of claim 1 wherein said cracking catalyst contains a rare earth-exchanged crystalline aluminum silicate.

* * * * *